US006774586B1

(12) United States Patent
Shih

(10) Patent No.: US 6,774,586 B1
(45) Date of Patent: Aug. 10, 2004

(54) TRASH BIN EQUIPPED WITH AN AUTOMATIC LIFTING LID

(76) Inventor: Tsung-Hwan Shih, 3F-1, No. 286-3, Shinya Rd., Kaohsiung City (TW)

( * ) Notice: Subject to any disclaimer, the term of this patent is extended or adjusted under 35 U.S.C. 154(b) by 83 days.

(21) Appl. No.: 10/283,265

(22) Filed: Oct. 30, 2002

(51) Int. Cl.[7] ..... E05F 15/20
(52) U.S. Cl. ..... 318/9; 100/43
(58) Field of Search ..... 318/9, 12, 14, 318/15; 100/43

(56) References Cited

U.S. PATENT DOCUMENTS 4,996,467 A * 2/1991 Day ..... 318/480
6,701,832 B1 * 3/2004 Hawkins ..... 100/49

* cited by examiner

*Primary Examiner*—Bentsu Ro
(74) *Attorney, Agent, or Firm*—Birch, Stewart, Kolasch & Birch, LLP

(57) ABSTRACT

A trash bin equipped with an automatic lifting lid includes a lid mounted onto a bucket. The lid has a base seat to hold batteries, a switch, a circuit board and an electronic component, a motor and a reducing gear box. The circuit board includes the electronic component and an induction controller which is extended to form an induction line located on the peripheral rim of the base seat. The reducing gear box is located on the rear end of the base seat and has a reducing gear set driven by the motor. One gear is extended above a trough located on the rear end of a shell to engage with another gear located at the rear end of an upper lid to transmit rotation and lift the upper lid. When energized by electricity, the induction line on the peripheral rim of the base seat may be induced to actuate automatic lifting of the upper lid to receive garbage.

5 Claims, 7 Drawing Sheets

TRASH BIN EQUIPPED WITH AN AUTOMATIC LIFTING LID

FIELD OF THE INVENTION

The present invention relates to a trash bin equipped with an automatic lifting lid and particularly a trash bin that has an induction line located on the periphery of the base seat of the lid for triggering a motor to lift the lid automatically to receive garbage.

BACKGROUND OF THE INVENTION

The trash bins with a lifting lid now available on the market generally are actuated by foot (as shown in FIGS. 1 and 2). The trash bin has a pedal located on the lower end of the trash bin that may be tapped by foot to lift the lid and open the trash bin to receive garbage. The pedal connects to the rear end of the lid through a L-shaped linkage bar to control the lifting movement. Such a construction still has problems in practice, notably:

1. The pedal is located on the lower end of the trash bin for lifting the lid to receive garbage. The lid closes automatically when user's foot moves away from the pedal. Thus the lid remains closed in normal conditions. However, the L-shaped linkage bar tends to be smeared by dust and dirt and result in losing automatic closing function.
2. The L-shaped linkage bar is prone to malfunction after used for a period of time. It also generates a lot of noise when in use.
3. Disabled people who have foot problems cannot use the pedal.

It is not convenient for some people.

SUMMARY OF THE INVENTION

Therefore the primary object of the invention is to resolve the aforesaid disadvantages. The trash bin with an automatic lifting lid according to the invention includes a bucket and a lid coupling with the bucket. There is an induction line located on the periphery of the lid. When an user approaches the opening of the trash bin, the induction line triggers a motor to automatically lift the upper lid open and closed so that use of the trash bin is more convenient and closing of the lid is more effective.

The foregoing, as well as additional objects, features and advantages of the invention will be more readily apparent from the following detailed description, which proceeds with reference to the accompanying drawings.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
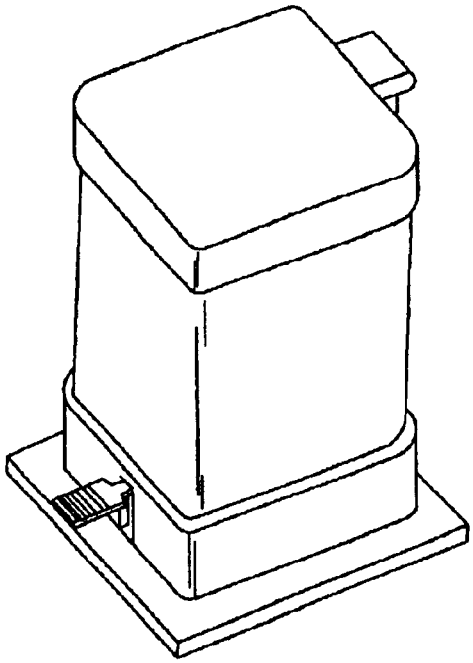
Fig. 1 PRIOR ART
FIG. 1 is a perspective view of a conventional trash bin equipped with a pedal.
Figure 2:
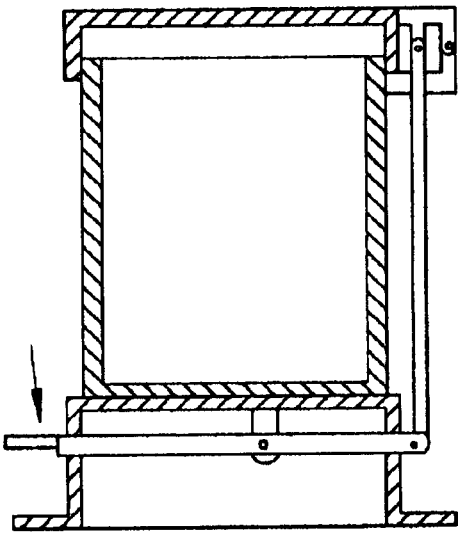
Fig. 2 PRIOR ART
FIG. 2 is a sectional view of a conventional trash bin equipped with a pedal.
Figure 4:
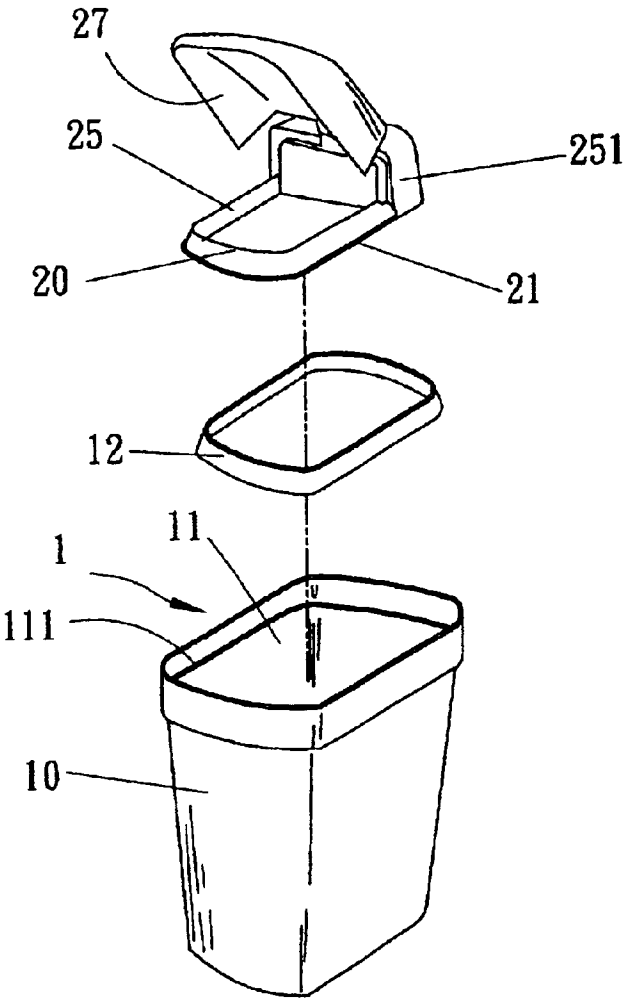
FIG. 4 is an exploded view of the invention according to FIG. 3.
Figure 3:
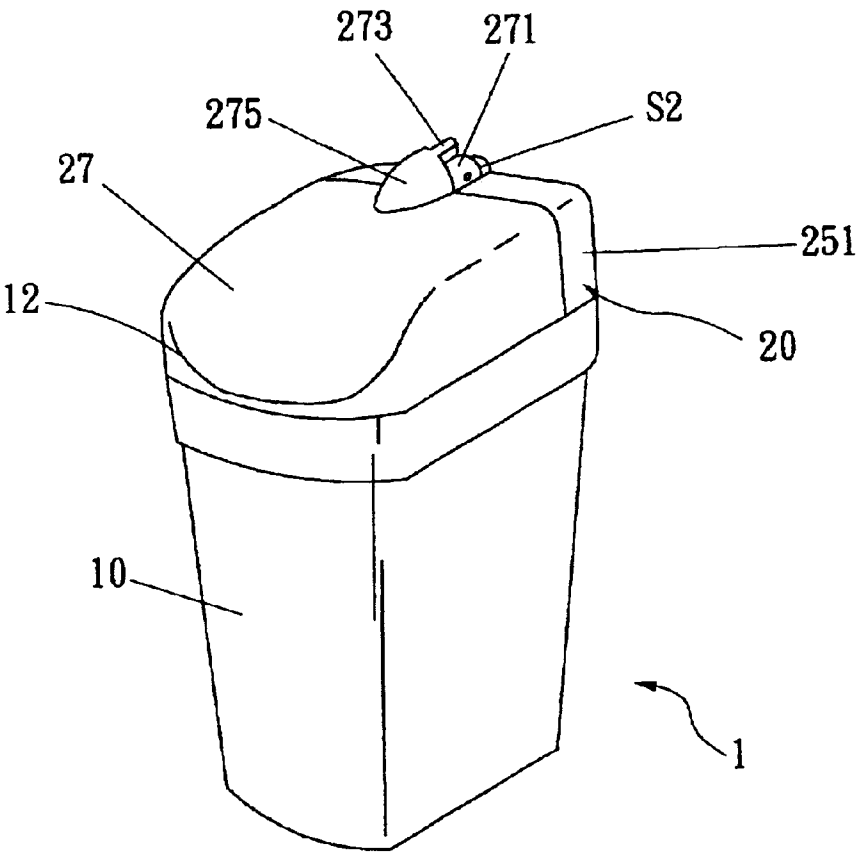
FIG. 3 is a perspective view of the invention.
Figure 5:
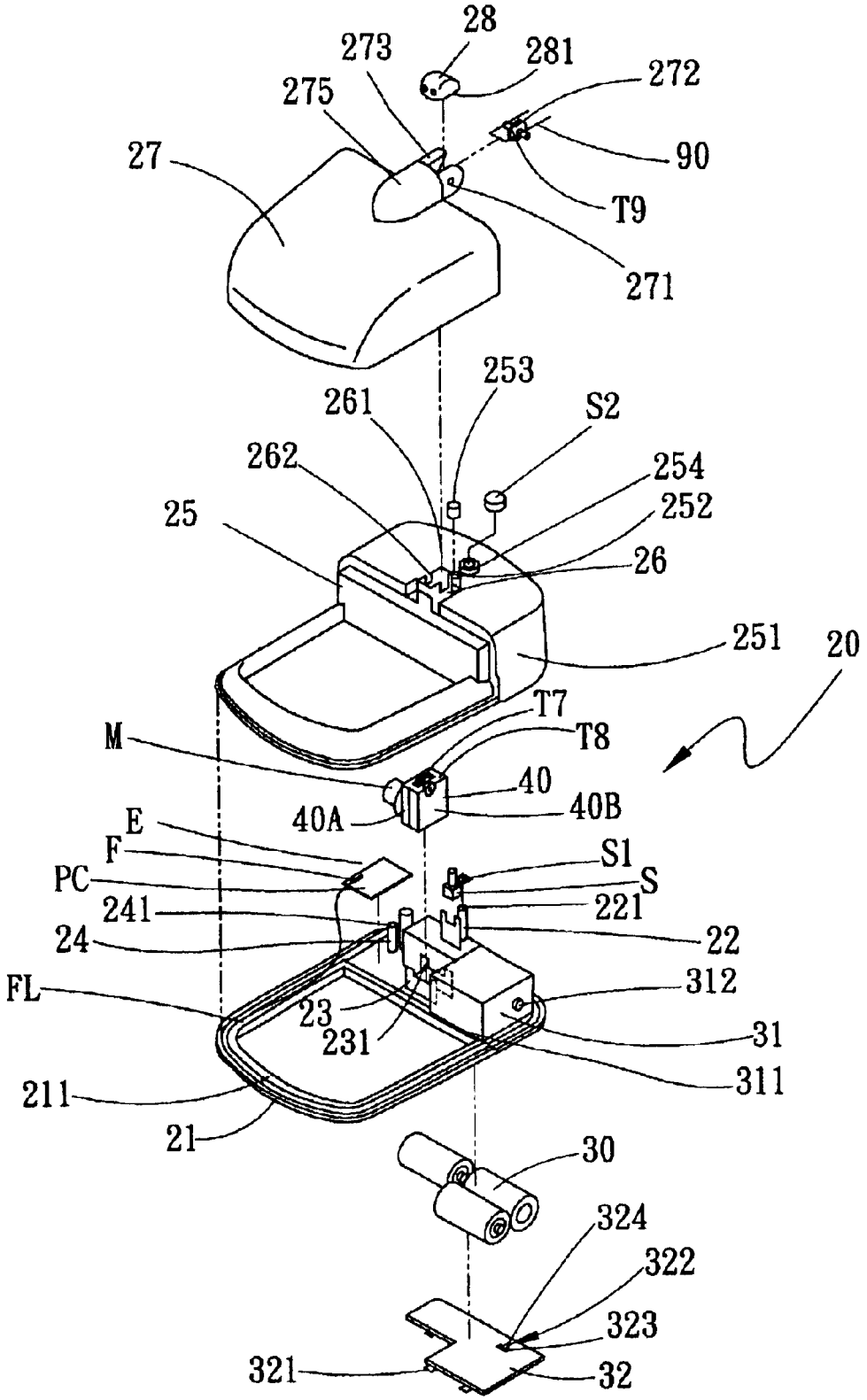
FIG. 5 is an exploded view of the lid according to FIG. 3.

Referring to FIGS. 3, 4 and 5, the trash bin of the invention consists of a bucket 10, a lid 20, a battery dock 31 and a reducing gear box 40.

Figure 8:
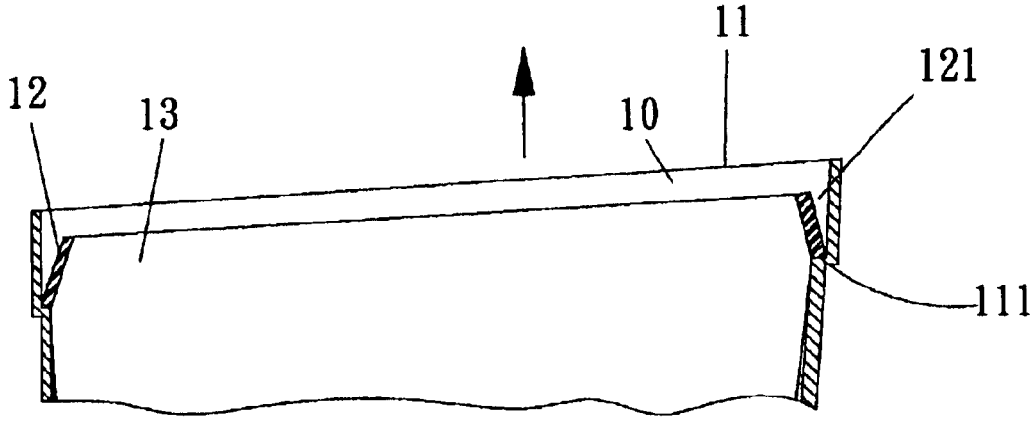
FIG. 8 is a fragmentary sectional view of the frame and bucket coupling together according to FIG. 3.
Figure 10:
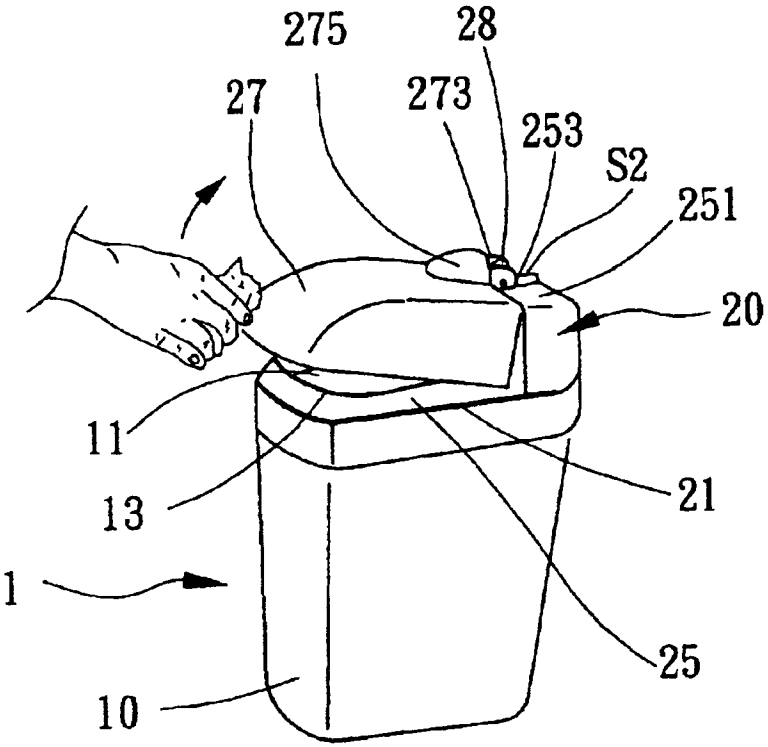
FIG. 10 is a schematic view of an embodiment of the invention in another use condition.

The bucket 10 has an opening 11 formed on the upper end to couple with the lid 20. Inside the opening 11, there is a bulged rim 111 for mounting a frame 12. The frame 12 may be coupled with a trash bag 13. The frame 12 is sloped with a narrower top side and a wider bottom side to couple with the frame 12 to form a gap 121 that is tapered at the lower portion (as shown in FIG. 8) to facilitate replacement of the trash bag 13.

The lid 20 is coupled on the opening 11 of the bucket 10. It is formed by bonding a base seat 21to a shell 25. There is a battery dock 31 located below the rear end and right side of the base seat 21 for housing batteries 30. The battery dock 31 behind the middle of the base seat 21 has a first strut 22 with a first screw hole 221 formed thereon for fastening a switch S. The left side of the battery dock 31 is extended to form two anchor plates 23 with notches 231 formed thereon to couple with the reducing gear box 40. There is a second strut 24 located at the rear end and left side of the base seat 21. The second strut 24 has a second screw hole 241 for fastening to a circuit board PC. The circuit board PC includes an electronic component E and an induction controller F which is extended to form an induction line FL located on the peripheral rim 211 of the base seat 21.

The shell 25 is bonded to the base seat 21 and has a hollow casing 251 at the rear end. The casing 251 has a trough 26 with an opening 261 corresponding to a notch 48 formed on the reducing gear box 40. The trough 26 has a semicircular recess 262 located in the middle between two sides thereof to couple with a pintle 272 which is engaged with two lugs 271 extended from the rear end of an upper lid 27. The pintle 272 is coupled with a gear T9 which corresponds to a gear T8 of the reducing gear box 40. There is a cavity 252 located behind the recess 262 for holding a pliable material 253. The pliable material 253 may press a jutting ledge 273 located on the rear end of the upper lid 27 when the upper lid 27 is raised to the ultimate position for holding the upper lid 27.

The cavity 252 has a round hole 254 formed on the rear side thereof to match and couple with an actuation rod Si of the switch S. There is a pushbutton S2 mounted onto the round hole 254 to trigger the switch S. The upper lid 27 is mounted closely onto the shell 25 and has an arched bump 275 located on a rear side that extends upwards from the middle to form the jutting ledge 273. The arched bump 275 has two sides extended to form two lugs 271 to couple with two sides of the trough 26 of the shell 25. The two lugs 271 are engaged with the pintle 272 in the middle. The pintle 272 is coupled with the gear T9 and a spring 90 which may aid lifting of the upper lid 27. The pintle 272 is located in the semicircular recess 262 of the trough 26 in the hollow casing 251 of the shell 25. The gear 79 is located in the opening 261 of the trough 26 to engage with the gear T8 located above the reducing gear box 40 mounted onto the base seat 21 for transmission. There is an anchor block 28 located in the trough 26 in the middle of a lower end thereof corresponding to an arched groove 281 formed in the semicircular recess 262 to anchor the upper lid 27.

The battery dock 31 has a trough 311 located at one end and a T-shaped coupling element 312 extended from the middle of another end to couple with a battery lid 32. The battery lid 32 has extended coupling lugs 321 corresponding to and engaging with the trough 311 of the battery dock 31. The battery lid 32 has another end with a coupling notch 322 formed thereon. The coupling notch 322 has a larger front end and a smaller rear end. For installation, the coupling lugs 321 at the front end of the battery lid 32 latch in the trough 311 of the battery dock 31, and the T-shaped coupling element 312 is engaged with a large coupling notch 323 at the front end of the battery lid 32. Then the T-shaped coupling element 312 may be pushed forwards to engage with a small coupling notch 324 located at the rear end.

Figure 6:
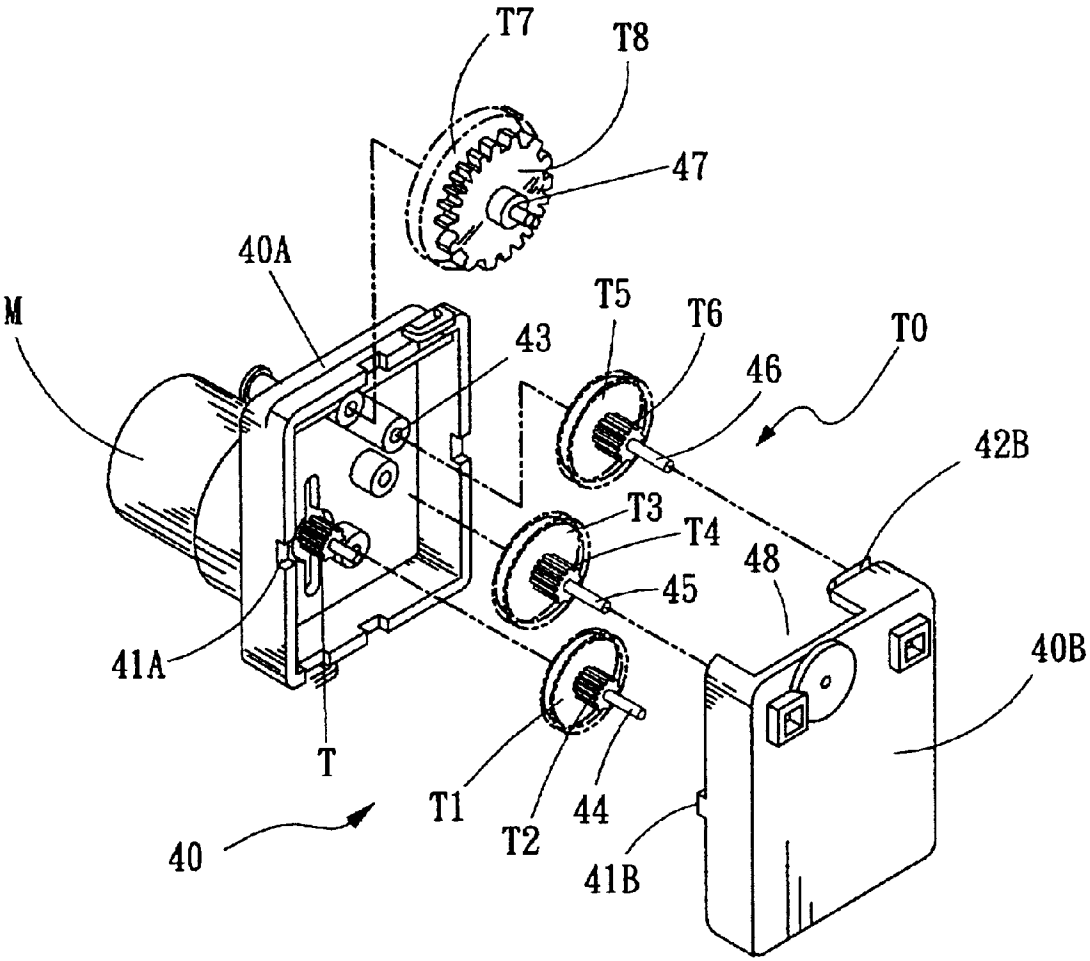
FIG. 6 is an exploded view of the reducing gear box according to FIG. 3.
Figure 7:
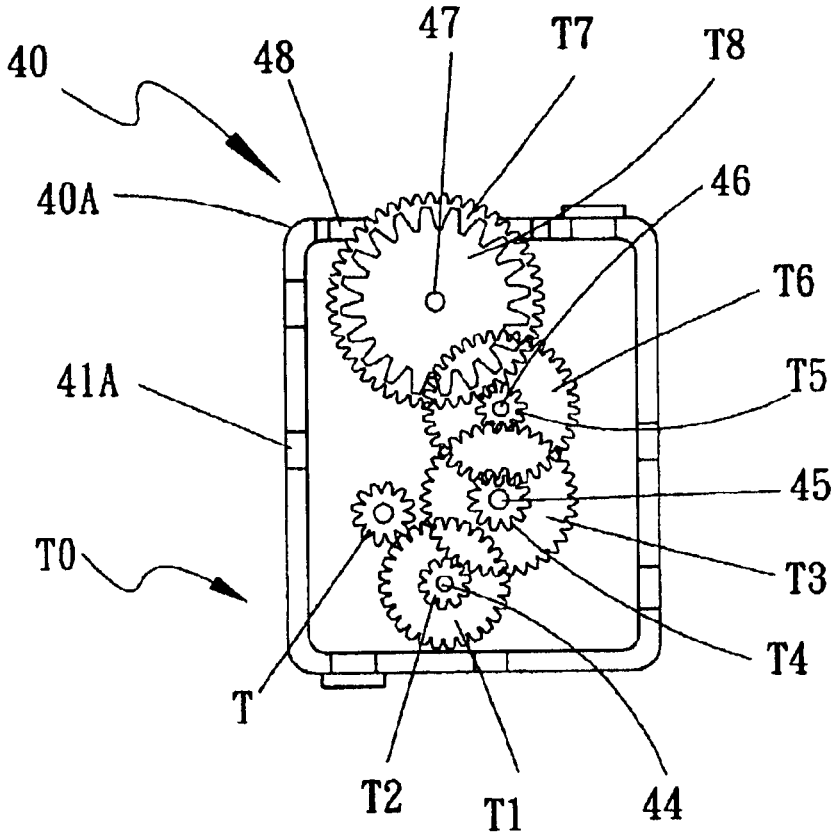
FIG. 7 is a schematic view of the reducing gear box according to FIG. 3, showing a transmission condition.

The reducing gear box 40 is engaged with the two notches 231 of the anchor plates 23 at the rear end of the base seat 21 as shown in FIGS. 6 and 7. The reducing gear box 40 includes a left shell 40A and a right shell 40B which have respectively a first latch groove 41A and a first latch lug 41B, and a second latch groove 42A and a second latch lug 42B formed on the peripheral rims thereof to couple with each other. There is a motor M located on a lower left portion of the left shell 40A. The motor M has a front end coupled with a gear T. The left shell 40A and the right shell 40B further have respectively four round holes 43 corresponding to each other. The round holes 43 engage respectively with spindles 44, 45, 46 and 47 to couple respectively with two gears T1 and T2, T3 and T4, T5 and T6, and T7 and T8. The gears T1, T3, T5 and T7 are larger gears and located respectively below the gears T2, T4, T6 and T8. The gear T engages with the gear T1, the gear T2 engages with the gear T3, the gear T4 engages with the gear T5, and the gear T6 engages with the gear T7. Thus when the motor M rotates and drives the gear T, the gear T1 also is driven by the gear T to rotate. As a result, the gear T2 located therebelow also rotate to drive the T3. By the same token, the gears T3, T5 and T7 also drive the gears T4, T6 and T8 to rotate. The upper end of the gear T7 and gear T8 extend outside the notch 48 of the reducing gear box 40. When the lid 20 is closed, the gear T8 is engaged with a lower side of the gear T9 located at the rear end of the upper lid 27.

Referring to FIG. 8, the frame 12 is located inside the bucket 10 of the trash bin 1 and is coupled tightly with an inner rim 15 of the bucket 10. The gap 121 is formed between the inner rim 15 and the frame 12 to facilitate replacement of the trash bag 13.

Figure 9:
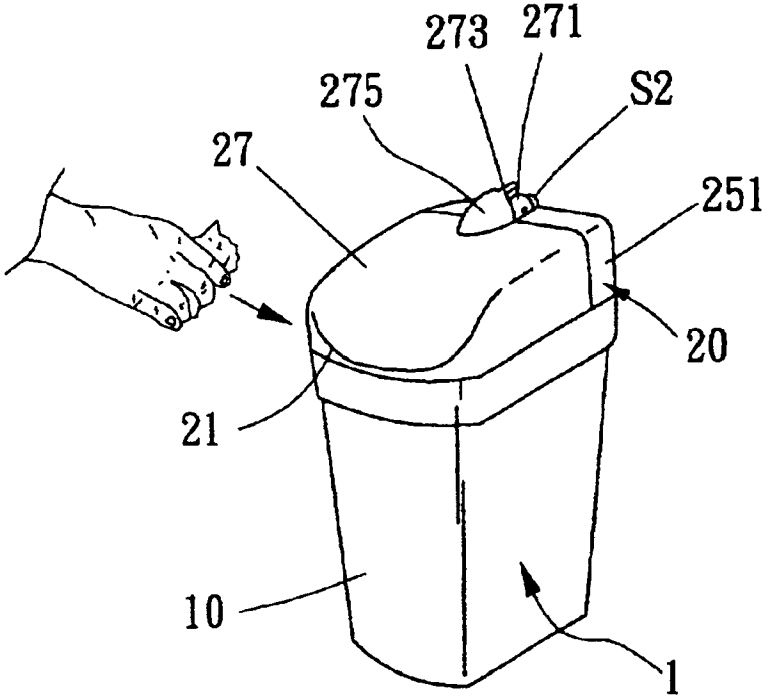
FIG. 9 is a schematic view of an embodiment of the invention in a use condition.
Figure 12:
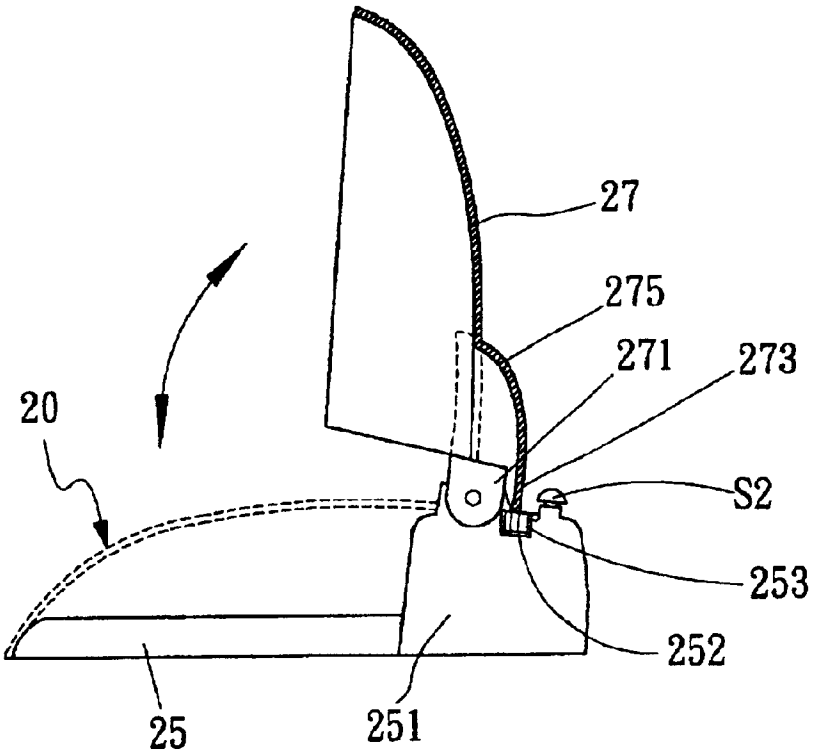
FIG. 12 is a fragmentary sectional view of an embodiment of the invention.
Figure 11:
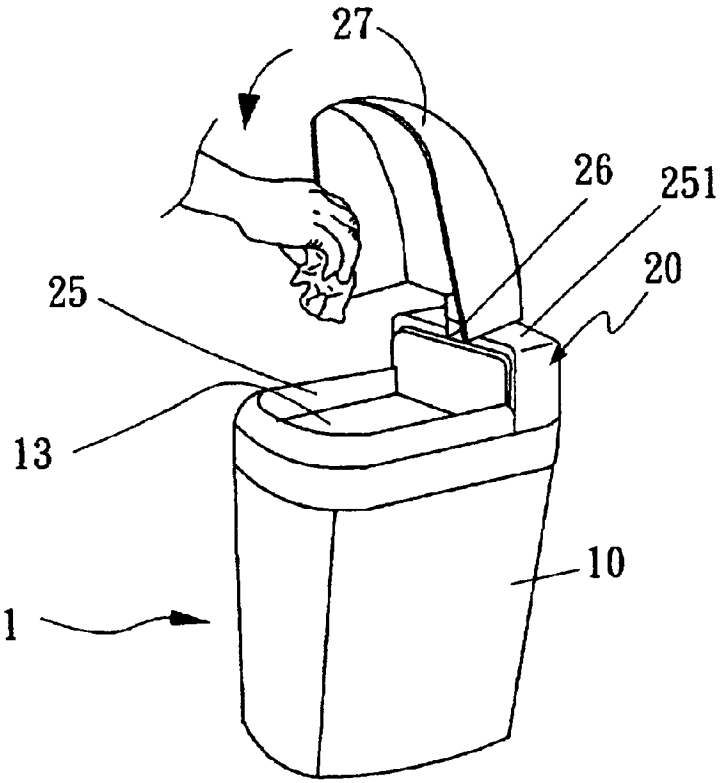
FIG. 11 is a schematic view of an embodiment of the invention in yet another use condition.

Referring to FIGS. 9 though 12, and also FIGS. 5–7, the induction line FL is located on the peripheral rim 211 of the base seat 21. When in use, the pushbutton S2 of the switch S is depressed. When user's hand is closed to the lid 20 of the trash bin 1 at a selected distance, the induction line FL generates a signal to the induction controller F to activate the motor M. The gear T is driven. Through the reducing gear set TO, the gear T8 extended outside the reducing gear box 40 is driven to transmit rotation to the gear T9 located on the rear side of the upper lid 27. As a result, the upper lid 27 is raised slowly to a highest position. The jutting ledge 273 on the rear side of the upper lid 27 inserts in the pliable material 253 located in the cavity 252 of the shell 25. The lifting is quiet without generating noise. Then the upper lid 27 moves down slowly to close the trash bin. Thus it is more convenient to use. Transmission, coupling, and opening and closing movements are accomplished by means of the motor and the gears, thus are more effective and less-likely to break down.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A trash bin equipped with an automatic lifting lid, comprising:

a bucket having an opening formed on an upper end thereof, the opening having a bulged rim formed therein for holding a frame, the frame having an upper side to engage with a lid;

a lid mounted onto the opening of the bucket including a base seat and a shell bonding together, the base seat having a battery dock located on a rear end and right side thereof, the battery dock behind the middle of the base seat having a first strut with a first screw hole formed thereon for fastening a switch, the battery dock having a left side extended to form two anchor plates with notches formed thereon to couple with a reducing gear box, the base seat having a second strut located at the rear end and left side thereof, the second strut having a second screw hole for fastening to a circuit board, the base seat further having an upper side coupling with a shell which has a hollow casing at a rear end thereof, the casing having a trough with an opening corresponding to a notch formed on the reducing gear box, the trough having a semicircular recess located therein between two sides thereof, the recess having a rear side forming a cavity for holding a pliable material to press a jutting ledge located on the rear end of an upper lid for holding the upper lid at a desired elevation when the upper lid is lifted to an ultimate position, the cavity having a round hole formed on a rear side thereof to correspond and couple with an actuation rod of the switch, the round hole housing a pushbutton for triggering the switch; an upper lid being closely mounted onto the shell and having an arched bump located on a rear side that extends upwards from the middle to form a jutting ledge, the arched bump having two sides extended to form two lugs to couple with a pintle in the middle thereof, the pintle being coupled with a gear and a spring which aids lifting of the upper lid, a spindle being located in the semicircular recess of the trough of the hollow casing at the rear end of the shell, the gear being located in the opening of the trough to engage with a gear located above the reducing gear box for transmission, the trough further coupling with an anchor block in the middle of a lower end thereof corresponding to an arched groove formed in the semicircular recess to anchor the upper lid;

a battery dock having a trough located at one end and a T-shaped coupling element extended from the middle of another end to couple with a battery lid, the battery lid having extended coupling lugs corresponding to and engaging with the trough of the battery dock; and a reducing gear box engaged with the two notches of the anchor plates having a left shell and a right shell that have respectively a first latch groove and a first latch lug, and a second latch groove and a second latch lug formed on the peripheral rims thereof to couple with each other, the left shell housing a motor on the lower left portion thereof, the motor having a front end coupling with a gear to drive a reducing gear set, two gears having an upper end extended outside a notch of the reducing gear box, the gear being engaged with a lower side of the gear located at the rear end of the upper lid when the lid is closed.

2. The trash bin equipped with an automatic lifting lid of claim 1, wherein the frame is sloped and has a narrower top side and a wider bottom side.

3. The trash bin equipped with an automatic lifting lid of claim 1, wherein the anchor block has an arched groove formed in the middle of the bottom thereof to anchor the upper lid.

4. The trash bin equipped with an automatic lifting lid of claim 1, wherein the battery lid has a coupling notch formed on another end thereof, the coupling notch including a larger coupling notch at the front end and a smaller coupling notch at the rear end thereof.

5. The trash bin equipped with an automatic lifting lid of claim 1, wherein the circuit board includes an electronic component and an induction controller which is extended to form an induction line located on the peripheral rim of the base seat.

* * * * *